United States Patent [19]

Tomac et al.

[11] Patent Number: 4,989,397

[45] Date of Patent: Feb. 5, 1991

[54] IN-LINE PACKAGE STRAPPING SYSTEM

[75] Inventors: Brian W. Tomac, Lodi; Stacey L. Overgaard, Madison; Carl R. Marschke, Phillips, all of Wis.

[73] Assignee: Marquip Inc., Phillips, Wis.

[21] Appl. No.: 365,091

[22] Filed: Jun. 12, 1989

[51] Int. Cl.[5] ..... B65B 13/04; B65B 63/02; B65B 27/08

[52] U.S. Cl. ..... 53/528; 53/530; 53/586; 53/588; 100/7

[58] Field of Search ..... 53/528, 530, 586, 588, 53/439; 100/7, 18, 19

[56] References Cited

U.S. PATENT DOCUMENTS

| | | | |
|---|---|---|---|
| 2,982,063 | 5/1961 | Coleman | 53/586 X |
| 3,766,708 | 10/1973 | Kubo | 53/586 X |
| 3,930,442 | 1/1976 | Buttner | 53/586 X |
| 4,178,739 | 12/1979 | DuBroff | 53/588 |
| 4,738,078 | 4/1988 | Benz | 53/530 X |

FOREIGN PATENT DOCUMENTS

| | | | |
|---|---|---|---|
| 2073128 | 10/1981 | United Kingdom | 100/7 |

*Primary Examiner*—John Sipos

*Attorney, Agent, or Firm*—Andrus, Sceales, Starke & Sawall

[57] ABSTRACT

An in-line strapping system which is particularly adaptable for strapping a compressible stack of sheet material includes a stack feeding mechanism which captures and holds the stack with its vertical side faces squared through the strapping cycle. A pair of vertically disposed compression belts captures the stack fed from an upstream squaring mechanism and feeds the stack into a strapping station to partially encircle the stack with a strap disposed in the path of movement. Only one lateral side of the stack is captured between the compression belt such that the stack is held in cantilevered fashion in the strapping station with the opposite lateral side unsupported. A rotary strap arm supports the partially wrapped strap and carries it around the unsupported rear portion of the stack to a sealing position overlapping the free end of the strap beneath the stack. A heat sealing apparatus seals the overlapping portions of the plastic strap, simultaneously cuts the strap to provide a new free end and clamps the new free end in a preliminary holding position. The strapped stack exits the system and the rotary strap arm continues in the same direction to an upper position and repositions the strap in the path of the next incoming stack. The heat sealing apparatus and associated strap clamping mechanism are operated by a common camshaft adapted to provide one complete operating cycle in a single revolution. The unidirectional rotation of the rotary strap arm allows the use of a much simplified strap clamping mechanism.

20 Claims, 10 Drawing Sheets

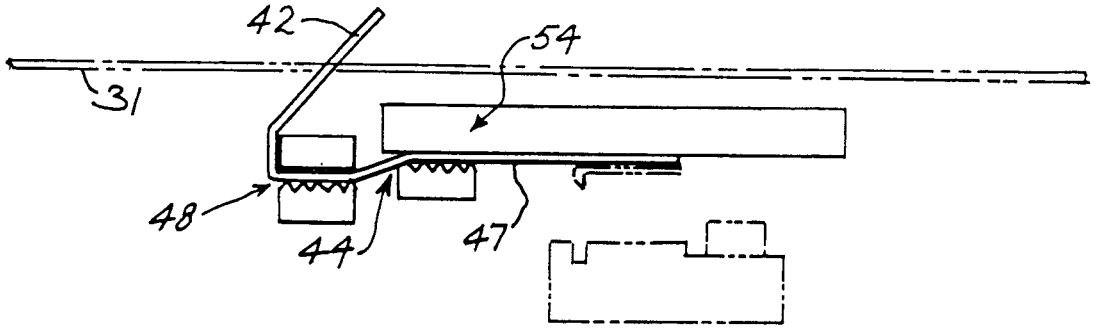
FIG. 15
FIG. 16
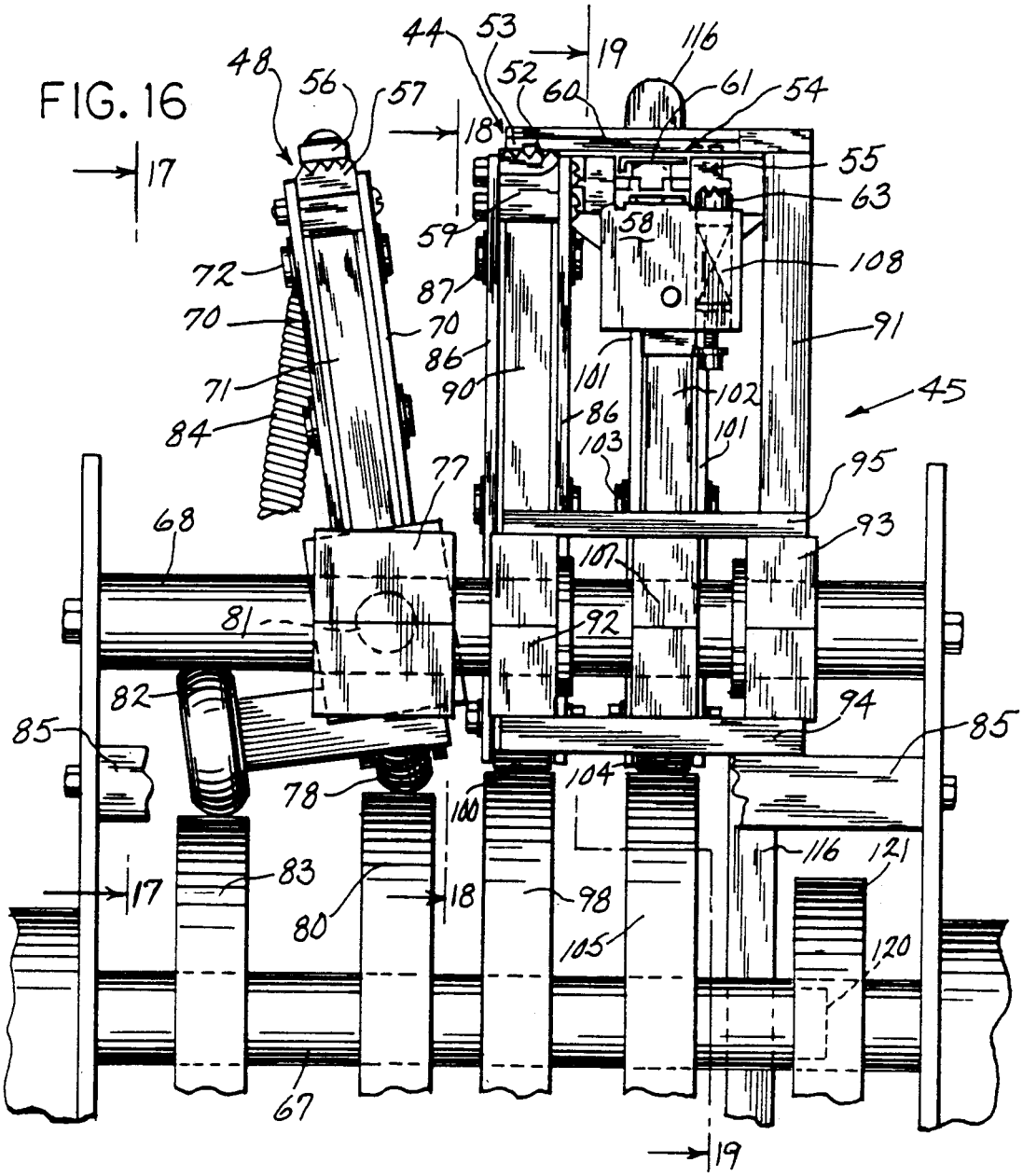

IN-LINE PACKAGE STRAPPING SYSTEM

BACKGROUND OF THE INVENTION

The present invention pertains to an apparatus for applying an encircling binding strap to a package being conveyed through a system and, in particular, to a system for strapping a compressible stack of sheets of corrugated paperboard by applying a strap around the stack in the direction of its movement through the system.

Various kinds of apparatus for banding or strapping packages being conveyed through a system are known in the art. In particular, packages comprising vertical stacks of sheet material, such as corrugated paperboard, may be secured by banding with a metal or plastic strap or tieing with cord or twine. Further, various systems are known for banding or tying such stacks automatically upon receipt from an upstream stacking apparatus and prior to palletizing or unitizing.

Specifically, one prior art system is utilized for strapping stacks of corrugated paperboard blanks used to construct cartons or boxes. The corrugated blanks or knocked-down cartons are formed in a so-called flexo-folder-gluer and, after formation, a specified number are automatically stacked and ejected into a strapping system. The strapping system typically includes a powered in-feed conveyor and a mechanism for squaring the stack and delivering it to a strapping station. After strapping, the stack is conveyed from the system for further processing, such as automatic unitizing with a plurality of similarly strapped stacks. A number of common problems have made the construction and operation of prior art strapping systems less than desirable. First of all, because of the wide variation in the size and shape of the corrugated sheets pre-formed in the flexo-folder-gluer, the centerline of a stack of such sheets or knocked-down cartons coming into the strapping system may be offset substantially from the centerline of the system. Thus, prior art strapping machines have typically been constructed to be movable laterally to place the centerline of the machine approximately coincident with the centerline of the stack of cartons being run at a particular time. Obviously, this requires a repositioning of the strapping machine each time blocks of different size corrugated sheets are run. In addition, lateral movement of the strapping machine will often displace it from the centerline of the downstream conveying equipment receiving the stapped bundles, resulting in further alignment and handling problems.

Because of the need for rapid handling and processing, the unbound stacks of sheets entering the strapping system tend to be out of square and must be squared before strapping so the final strapped bundle is also square and to prevent edge damage to displaced sheets. Typical prior art systems thus include side tamps on the in-feed conveyor to square the lateral sides of the stack and establish the stack generally on the longitudinal centerline through the system. To square the forward and rear faces of the stack, some prior art systems simply rely on a vertically disposed pusher which is automatically positioned behind the stack on the in-feed conveyor to simultaneously square the rear edges of the sheets and push the stack into the downstream strapping position. However, merely pushing the stack from the rear does not assure that the front and rear faces will be squared. In addition, movement of the stack out of the side tamps and into the strapping position often results in momentary loss of positive stack retention, again resulting in loss of stack squareness. After the stack of corrugated sheets is received in the strapping station, it is typically vertically compressed before the encircling strap is applied and, after the strap ends are secured, the compression is released and the expanding stack provides the necessary tension in the strap to secure the stack. Obviously, if the stack is not square at the time it is compressed, the strapped stack will also be out of square. Sometimes it is necessary or desirable to process stacks of knocked-down cartons or the like through the system without strapping. In such cases, failure to maintain or loss of stack squareness will also adversely affect downstream processing.

One prior art device which utilizes a pusher to engage the rear face of the stack and push it into the strapping station, attempts to establish and retain front and rear face squareness by pushing the stack into the rear face of the downstream stack which has just been strapped and to simultaneously push the strapped downstream stack from the strapping station. Nevertheless, there is still a momentary loss of positive stack retention in the transfer from the in-feed conveyor to the strapping station and, in addition, if the downstream strapped stack is out of square, the unstrapped stack pushed into it may be knocked out of square as well.

This same prior art system utilizes a strapping mechanism which holds the free end of a continuous supply of strap below the plane of the stack and an upper intermediate portion above the stack such that the strap end portion lies in a vertical plane in the path of a stack coming into the strapping apparatus. The incoming stack is pushed into the strap, the strap is played out from the continuous supply above, and continuing downstream movement of the stack into the strapping station results in partial wrapping of the stack around its front face and portions of the top and bottom. The upper intermediate strap portion is supported by a hook-shaped arm which is adapted to swing downwardly past the rear of the partially wrapped stack and through a longitudinal slot in the strapping apparatus to carry the intermediate strap portion to a point overlapping the free end held below the stack. The overlapping portion of the plastic strap is heat sealed, the strap is severed to form a new free end which is held below the plane of the bottom of the stack, and the strap arm reverses and swings back upwardly to its upper supporting position, playing out a suitable length of strap which is automatically positioned in the path of the next incoming stack. The system also includes a vertically reciprocable compression plate in the strapping station which compresses the stack just prior to completion of strapping and holds it until the heat sealed connection is made. As indicated, however, this system is characterized by an absence of positive stack retention from squaring through strapping and heat sealing, such that the squareness of the strapped stack cannot be positively assured. In addition, the reciprocating movement of the strap carrying arm requires a complex clamping mechanism in the heat sealing area which must provide for the strap both lateral and longitudinal linear movement, as well as rotary movement through 360° to properly orient the new free end of the severed strap. Finally, the strap cutting mechanism requires rather precise alignment, and loss of alignment can result in serious damage to the heat sealing apparatus.

SUMMARY OF THE INVENTION

The system of the present invention is characterized by a construction which overcomes all of the problems characteristic of prior art in-line strapping systems, particularly those adapted to strap a compressible stack of sheet material such as corrugated paperboard. The in-feed conveyor for the system has a wide lateral entry window and center justifying side tamps, allowing the system to accept stacks with large lateral offsets which are readily centerable by the side tamps, thereby precluding the need to move the strapping equipment laterally to accommodate size and shape variations in different batches. Problems with alignment of downstream equipment for handling the strapped stacked are also automatically obviated. The in-feed conveyor includes a squaring apparatus which squares the stack laterally and longitudinally, holds the square until the stack is captured by a compression and holding conveyor. The conveyor carries the stack into the strapping station where the squareness is held while a plastic strap is fed from a continuous supply, wrapped around the compressed stack and secured upon itself by heat sealing. The compressing and holding conveyor in the strapping station is offset laterally to one side, such that the other side of the stack is unsupported and held in a cantilevered fashion. The unsupported side of the compressed stack provides an open area for the operation of a unique rotary strap arm which rotates in one direction in 180° increments from an upper pre-wrapping position to a lower heat sealing position. The uni-directional rotation of the strap arm eliminates the need for a complex rotary clamp for orienting and positioning the free end of the strap. A unique heat sealing element provides simultaneous severing of the strap without critical alignment problems characteristic of prior art devices.

More specifically, the in-line strapping system of the present invention includes a squaring station having an in-feed conveyor which supports the stack and conveys it into a squaring area. A pair of laterally reciprocable side tamps are disposed over the in-feed conveyor on opposites side of the stack and are movable laterally to engage and square the side faces of the stack and simultaneously center the stack on the centerline of the system. An end squaring conveyor is attached to each of the side tamps and synchronized to move at the same speed as or slightly faster than the in-feed conveyor, and includes vertically disposed pusher dogs that are adapted to engage the rear lateral edges of the stack to square the forward and rear end faces and to assist in moving the stack out of the squaring station and into the strapping station. The forward ends of the side tamps include pivotal spring or inertially loaded gates into which the front face of the stack is moved to assist in squaring. These gates swing out of the way as the stack exits the squaring station. The strapping station includes a pair of parallel horizontally disposed and vertically spaced belt conveyors which are offset laterally to one side of the centerline of the stack. The upper belt conveyor is movable vertically toward the lower belt conveyor to compress the stack therebetween as it is moved into the strapping position and to hold the stack by the side on which the belt conveyors are located, such that the other side of the stack is generally unsupported and held in an essentially cantilevered orientation. The strapping apparatus includes a supply of a continuous length of strap the lower free end of which is clamped and held below the plane of the lower belt conveyor and an intermediate portion of which is held above the incoming stack by a rotary strap arm adapted to receive an on-demand supply of strap from the supply. The end portion of the strap is disposed in a pre-wrapping position in a vertical plane parallel to the centerline and in the path of the incoming stack. The incoming stack, compressed between the belt conveyors, is moved into the strap in its pre-wrapping position to cause the strap end portion to wrap around the forward face and portions of the upper and lower faces of the stack. The partially strapped stack is stopped in a position such that the rotary arm, carrying the intermediate strap portion, can rotate downwardly past the unsupported rear face of the stack to a connecting position below the stack and overlapping the free end of the strap. A heat sealing apparatus operates to connect the overlapping strap portion with a fused heat seal to enclose the stack. The strap is simultaneously cut as the heat seal is formed and the new free end is retained in the lower position by an appropriate clamp. The strapped stack is conveyed out of the strapping position by the belt conveyors which are also moved apart to release the compression and tension the strap. When the strapped stack has exited the strapping station, the rotary strap arm is rotated approximately 180° in the same direction to its upper pre-wrapping position, while the new free end remains clamped below, thereby orienting the strap end portion in the pre-wrapping position for receipt of the next incoming stack. Utilizing a rotary strap supply mounted coaxially with the strap arm precludes twisting of the strap.

The heat sealing assembly includes a unique mechanism for clamping and holding various parts of the strap end portion in the sealing area, including a reciprocal heating element and cutting knife, all of which is moved into and out of the strap plane and into and out of clamping engagement with the strap under the control of a camshaft providing a full cycle of operation per revolution for direct and precise control of the operating sequence. The uni-directional rotation of the strap arm around the rear edge of the stack to the sealing position and back to the upper pre-wrapping position allows the use of a much simpler strap clamping and feed mechanism which eliminates the need to rotatably reorient the free end of strap with each strapping cycle.

BRIEF DESCRIPTION OF THE DRAWINGS

FIGS. 8–15 are enlarged side elevations showing, generally schematically, the operation of the heat sealing assembly with reference to the FIG. 3–7 sequence.

FIG. 16 is a side elevation showing details of the construction of the eat sealing apparatus.

DETAILED DESCRIPTION OF THE PREFERRED EMBODIENT

Figure 1:
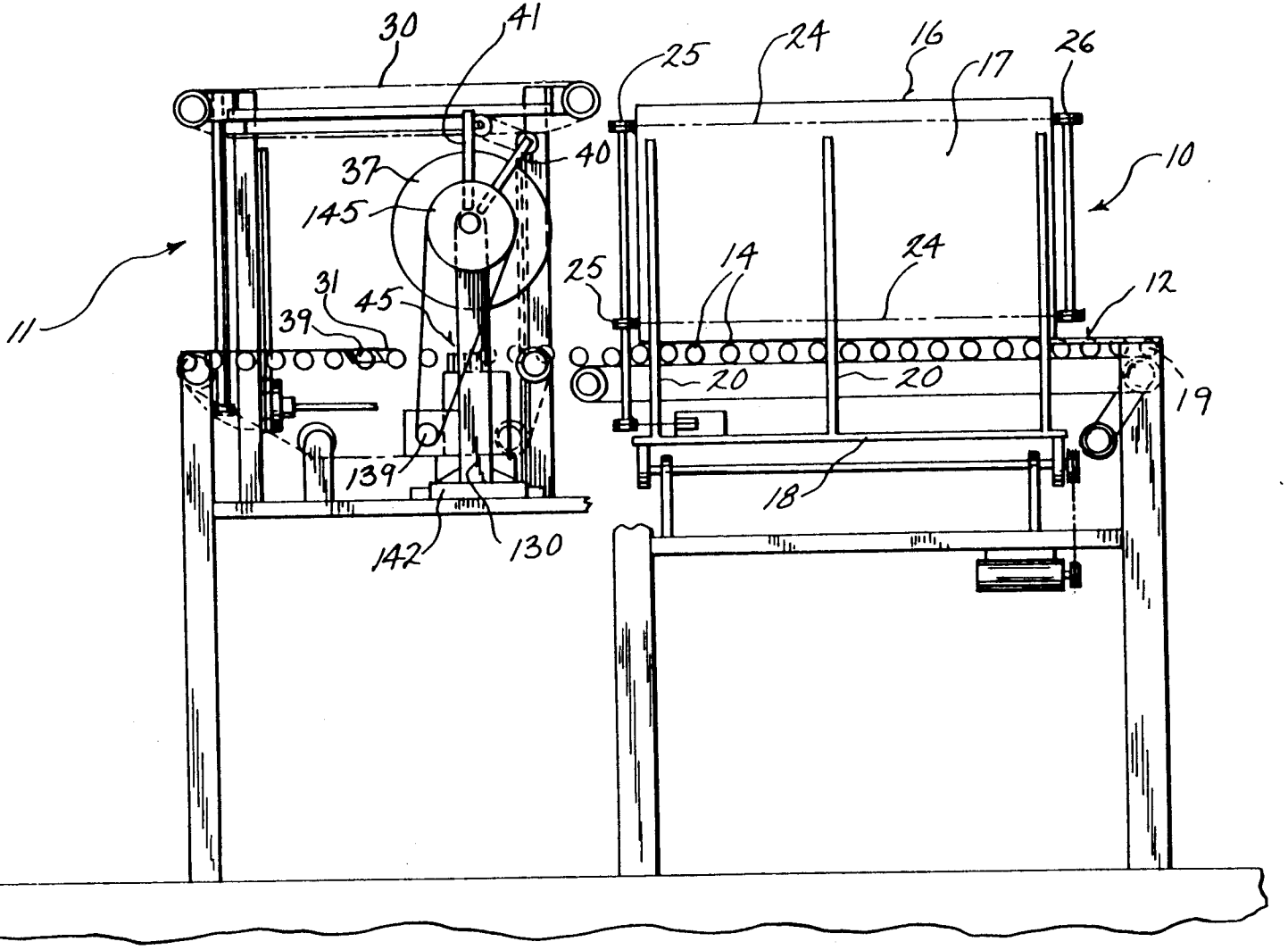
FIG. 1 is a side elevation view of the overall in-line strapping system of the present invention.
Figure 2:
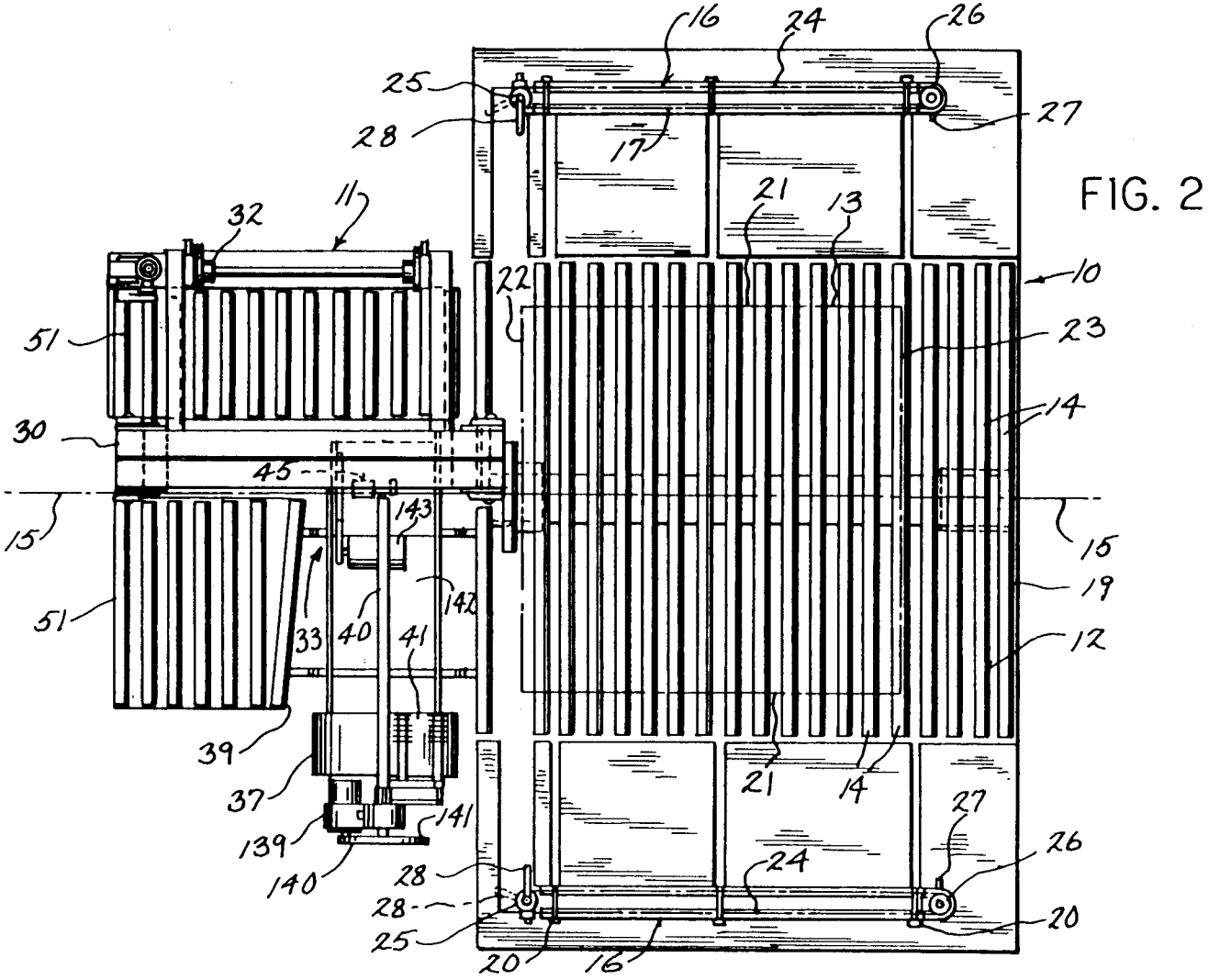
FIG. 2 is a top plan view of the system shown in FIG. 1.

Referring initially to FIGS. 1 and 2, the in-line strapping system shown therein includes an upstream squaring station 10 and a directly interconnected downstream strapping station 11. The squaring station 10 includes an in-feed conveyor 12 which may typically receive a stack 13 of corrugated paperboard sheets from the stacking mechanism in a flexo-folder-gluer (not shown), which sheets comprise the blanks for cartons or boxes. The in-feed conveyor 12 comprises a live roll conveyor of conventional construction including a series of powered rollers 14 extending along its length. The in-feed conveyor may include an acceleration roller 19 positioned at its upstream end and operated at an intermediate speed to bring the incoming stacks up to the speed of the in-feed conveyor. The in-feed conveyor 12 is characterized by its substantial width, allowing it to accept both unusually wide stacks and stacks which because of the unusual shape of the sheets are offset substantially from the centerline 15 of the system. Thus, the entire system including both the squaring station 10 and interconnected strapping station 11 can be bolted directly to the floor and yet accept a wide range of stacks of sheets of substantial width and/or lateral offset.

A pair of side tamps 16 are mounted above the conveying surface of the in-feed conveyor 12 on opposite lateral sides of the system centerline 15. Each of the side tamps 16 is mounted on a carriage 18 disposed below the in-feed conveyor 12 and supported by guides 20 adapted to move laterally with the carriage 18 in the space between adjacent rollers 14. Thus, the side tamps 16 are adapted to move laterally inwardly to center the stack 13 on the system centerline 15 and simultaneously square the side faces 21 of the stack. Each of the side tamps 16 includes a pusher conveyor 17, each of which is synchronized with the in-feed conveyor 12 to operate at the same speed or slightly faster. Each pusher conveyor 17 includes a pair of upper and lower conveyor chains 24 operating around forward driven sprockets 25 and rear idler sprockets 26. Extending between the upper and lower conveyor chains 24 and at spaced intervals along the length thereof are vertically disposed pusher dogs 27 adapted to engage the rear corners of the stack 13 after the side tamps 16 have moved in to center the stack and square the side faces 21. The centering and side squaring of the stack 13 are accomplished with the in-feed conveyor inoperative. After centering and squaring, and with the side tamps 16 just in contact with the side faces 21 of the stack, both the in-feed conveyor 12 and the pusher conveyors 17 are operated to move the stack toward the downstream end of the pusher conveyors at which point the forward edges of the stack engage pivotal gates 28 mounted on the vertical axes of the driven sprockets 25 and adapted to rotate thereabout when engaged by the moving stack. However, initial engagement of the gates 28 by the stack 13 causes the forward end face 22 and rear end face 23 to be simultaneously squared between the gates 28 and pusher dogs 27, respectively.

The fully squared stack 13 is pushed past the pivotal gates (which may be spring loaded or inertially loaded and adapted to return to their engaging position after the stack has passed), under the influence of movement provided by both the in-feed conveyor 12 and the pusher dogs 27 on the conveyors 17, into the upstream end of the strapping station 11 and between vertically spaced upper and lower belt conveyors 30 and 31, respectively. Upper and lower belt conveyors are synchronized and are operating at the same speed which is slightly slower than the speed of the in-feed conveyor and pusher conveyors. The presence of the leading edge 22 of the stack 13 in the upstream end of the strapping station 11 activates a vertical drive mechanism 32 operatively attached to the upper belt conveyor 30 to move it vertically downward and into engagement with the upper surface of the stack 13. The stack is thus captured between the upper and lower belts and carried into the strapping station. It is important to note that the stack is captured between the upper and lower conveyor belts 30 and 31 while the rearward portion of the stack remains between the side tamps 16 and engaged at its rear face by the pusher dogs 27. As a result, the stack is completely square when it is engaged by the upper and lower conveyor belts 30 and 31 and is compressed and held therebetween until the subsequent strapping operation is completed.

The upper and lower belt conveyors 30 and 31 are vertically aligned with each other but offset laterally to one side of the system centerline 15. In their offset position, the belt conveyors are adapted to capture and hold the stack by only one side, such that the other side is generally unsupported and hangs in cantilevered fashion into an open area 33 on the other side of the centerline 15 from the belt conveyors 30 and 31. It is in this open area 33 that the package or stack 13 is strapped and the strap heat sealed, as will be described in more detail hereinafter.

Figure 20:
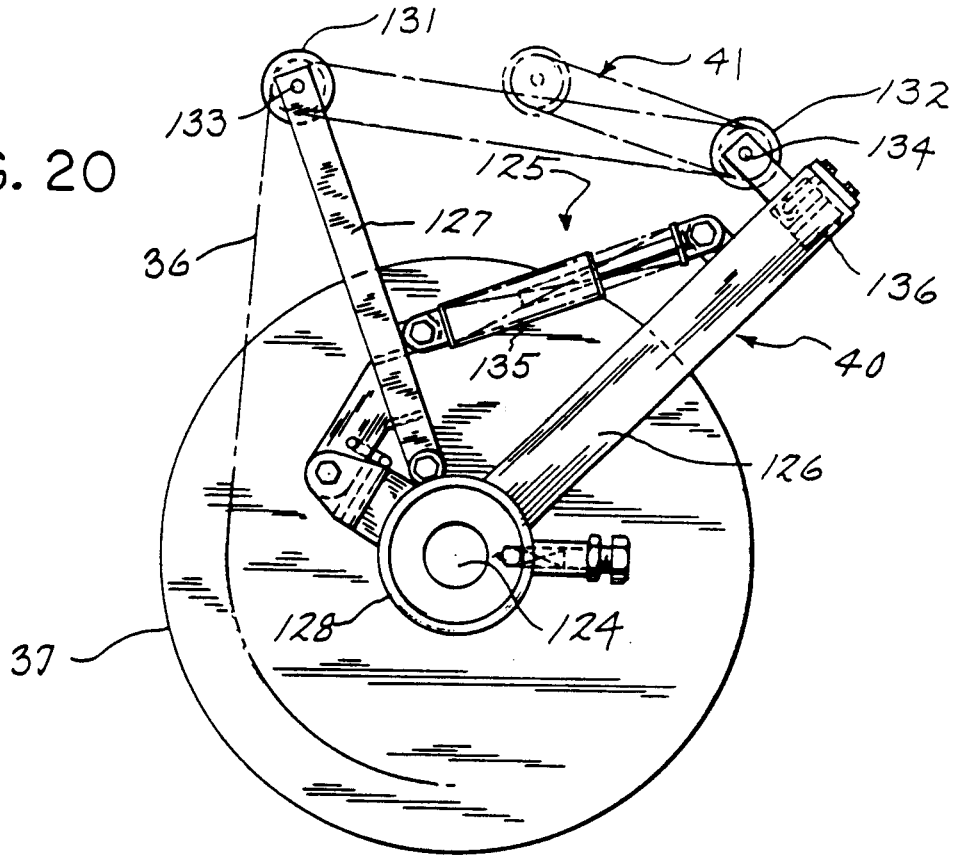
FIG. 20 is an enlarged side view of the strap arm and strap supply mechanism.
Figure 21:
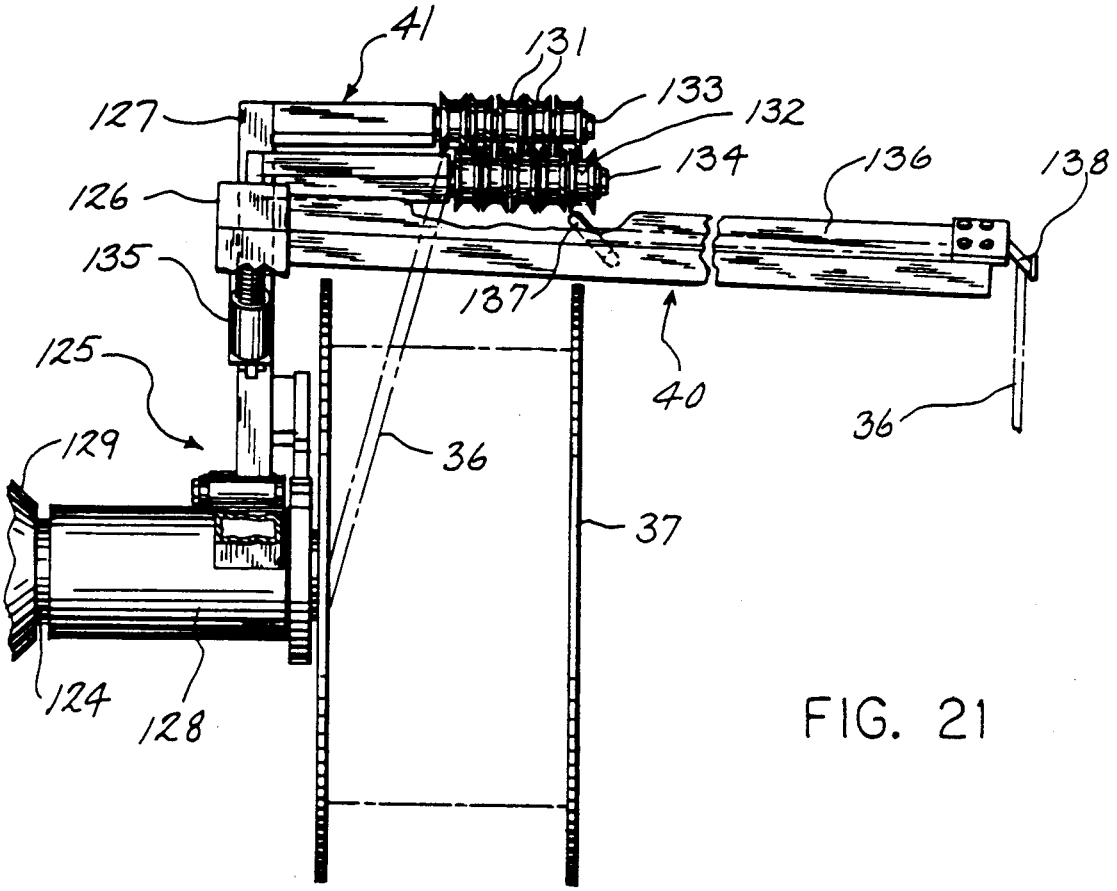
FIG. 21 is an end view of the mechanism shown in FIG. 9.

Referring also to FIGS. 3–7, showing the sequence of operation, the overall operation of the strapping station 11 will now be described. Beginning with the compressible stack 13 of corrugated paperboard sheets being conveyed out of the squaring station 10 and into the strapping station 11, the forward edge 22 of the stack is detected by a first position sensor, such as photo detector 34, causing the upper belt conveyor 30 to move vertically downward to engage and compress the stack and carry it further into the strapping station. When the forward edge of the stack 13 is sufficiently in the grasp of the conveyors 30 and 31, the side tamps 16 retract but, by this time, the stack is securely held between the belt conveyors 30 and 31. A continuous length of strap 36 is contained on a supply roll 37 supported by a roll arm 38 in the open area 33 and spaced laterally outward from the unsupported end of the stack 13. Strap 36 from the roll 37 is supplied to a rotary strap arm 40 mounted on the axis of the roll 37 and adapted to rotate thereabout. The strap arm 40 is hollow and the strap 36 is fed through it to an open end disposed generally in the plane of the centerline 15 of the system. A strap take-up system 41 is attached to the strap arm 40 for rotation therewith and receives a supply of strap from the roll 37 before it is threaded through the strap arm 40 and out of the unsupported inner end. The take-up system 41 may comprise a conventional dancer apparatus as shown in FIGS. 20 and 21 and to be described in more detail hereinafter. A strap end portion 42 is supported in a pre-wrapping position (shown in FIG. 3) in the path of the incoming stack 13 and in a vertical plane through the centerline 15 of the system or offset somewhat laterally therefrom into the open area 33. As will be described in more detail hereinafter, the entire strapping apparatus may be supported so it can be moved laterally to strap in a vertical plane offset slightly from the centerline 15 in order to avoid wrapping the strap into vertical slots in the corrugated sheets of certain stacks which are oriented directly on the centerline. The free end 43 of the strap end portion 42 is clamped in a front clamp 44 forming part of the heat sealing assembly 45 disposed generally in the open area 33 and below the plane of the lower surface of the stack 13. The opposite intermediate part 46 of the strap end portion 42 is supported by the end of the strap arm 40 above the top surface of the incoming stack 13. As used herein, the strap end portion 42 is intended to mean that length of strap 36 from the end of the strap arm 40 to the lower free end 43, which end portion 42 will vary substantially in length with the size of the stack 13 and with the position of the strap and strap arm during the strapping and sealing sequence. In addition, the strap end portion 42 remains disposed in the previously described vertical plane throughout the strapping process which plane is sometimes hereinafter referred to as the strap plane.

Figure 4:
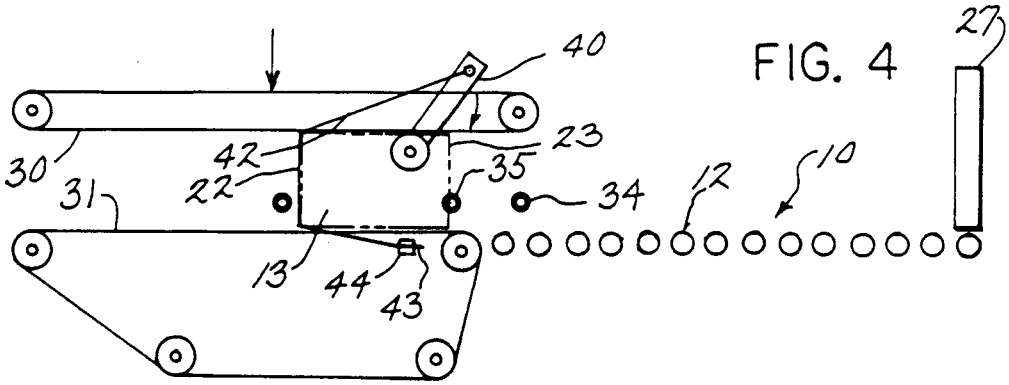

Referring also to FIG. 4, the forward face 22 of the stack 13 compressed between and conveyed by belt conveyors 30 and 31 engages the strap end portion 42 and continuing downstream movement causes the strap to wrap around the forward face and portions of the upper and lower faces of the stack. The lower free end 43 of the strap end portion 42 remains clamped in the front clamp 44 and the additional length of strap material needed to partially wrap the stack is played out through the strap arm 40 from the roll 37 under the control of the take-up system 41. When the stack has advanced to a position where the rear end face 23 is sensed by the second photodetector 35, the belt conveyors 30 and 31 are stopped and the stack is temporarily held stationary for completion of the strapping and heat sealing process. Although a shorter length stack 13 may extend unsupported into the open area 33, stacks which are longer in the direction of movement than the open area will extend over and be partially supported at their forward edges by a slider plate 39. The slider plate has a downwardly sloping edge surface to help lift a stack edge which may have sagged under its own weight.

Figure 5:
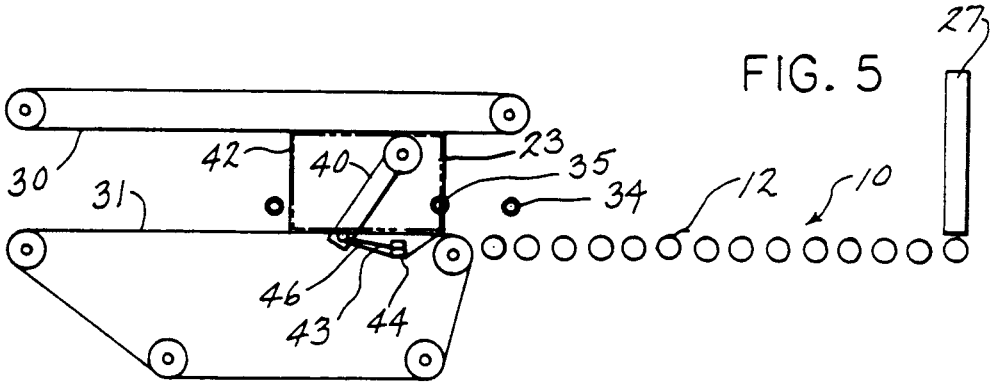
Figure 6:
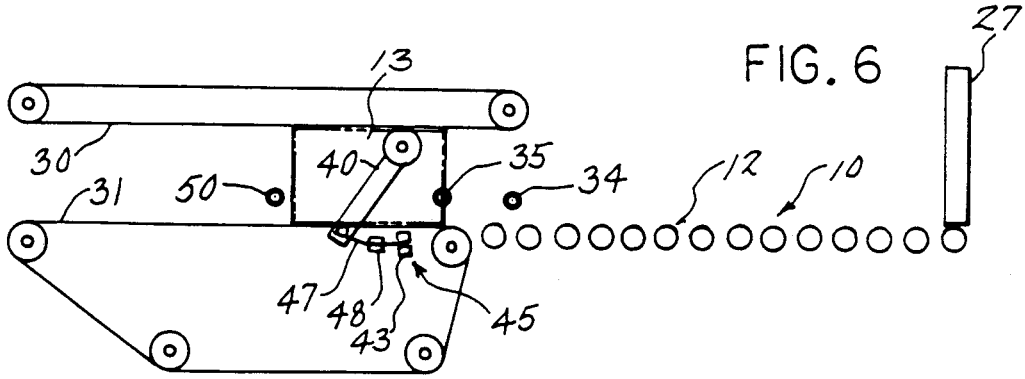

Referring to FIG. 5, with the stack in the stopped position, the strap arm 40 rotates downwardly (in a clockwise direction as shown) through the open area 33 and past the rear end face 23 of the stack to a position below and slightly past the free end 43. This increment of rotation is approximately 180°. Again, the strap end portion 42 increases in length with rotation of the strap arm 40 with the additional length of strap played out from the take-up system 41 and supply roll 37. The strap arm 40 stops in a lower sealing position (FIG. 5) with the intermediate part 46 of the strap end portion 42 overlapping the free end 43. As shown schematically in FIG. 6, the heat sealing assembly 45 operates to heat seal the overlapping strap portion and to simultaneously sever the strap to provide a new free end 47 which is held by a loading clamp 48 which is operative to grip the strap just prior to heat sealing and cutting. The portion of the heat sealing assembly 45 actually providing the heat seal and cutting functions moves laterally out of the strap plane and the fully strapped stack 13 may be moved out of the strapping station 11 to exit the system by operating the belt conveyors 30 and 31.

Figure 3:
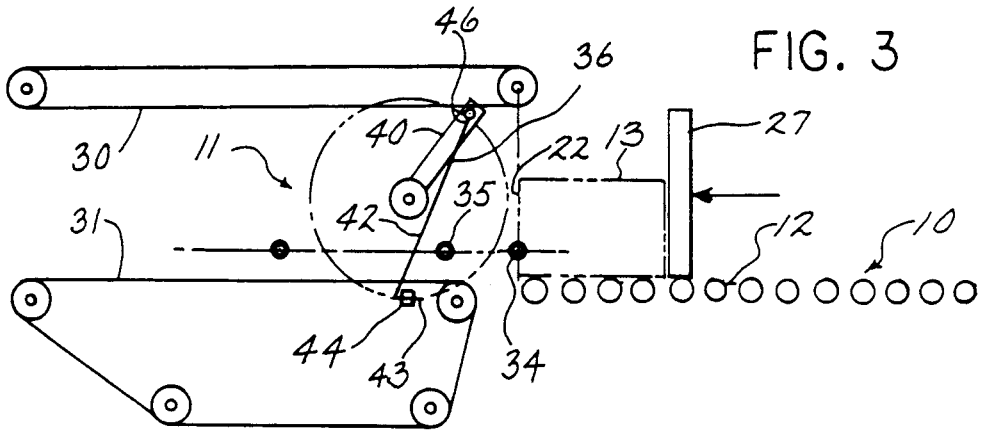
FIGS. 3–7 are schematic side elevations showing the sequence of movement of a stack through the system and the general operation of the strapping and heat sealing apparatus.
Figure 7:
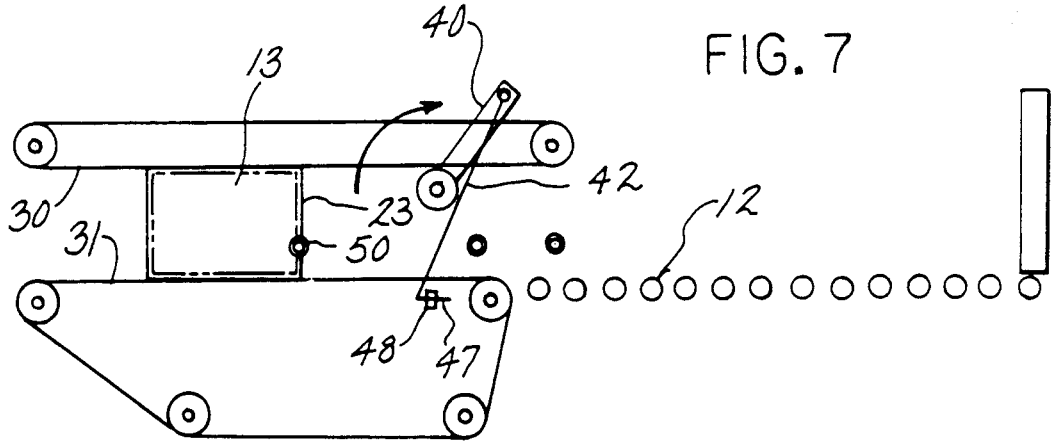

As shown in FIG. 7, the stack moves downstream and, when the rear end face 23 is detected by a third photodetector 50, the strap arm 40 is activated to rotate upwardly in the same counterclockwise direction, through an arc of about 180°, to the FIG. 3 position. The new free end 47 remains held below by the loading clamp 48 and the strap end portion 42 increases in length as the strap arm rotates upwardly and the strap is played out from the supply roll 37. As the strapped stack 13 moves out of the strapping station it is conveyed onto a pair of supporting idler roll conveyors 51 (FIG. 2) over which it is conveyed by the belt conveyors 30 and 31. Simultaneously, the upper belt conveyor 30 moves vertically upward, the compression on the stack is released, and the expanding stack places the encircling strap in a tension adequate to secure it for further downstream processing. Typically, the strapped stack exits into a unitizing mechanism adjacent the downstream end of the system. As indicated previously, maintenance of the stack centered on the system centerline 15 allows it to be discharged therefrom in a precise location necessary for the in-feed alignment requirements of the downstream unitizer. The need for makeshift stack handling systems to bridge a misaligned strapper and unitizer are, therefore, obviated.

Figure 8:
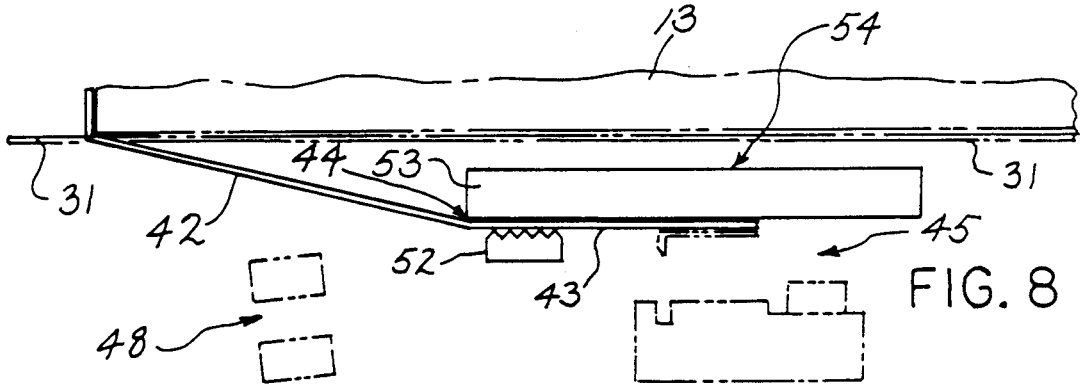

Referring to FIGS. 8–15, the sequence of operation of the heat sealing assembly 45 will now be described in greater detail. FIG. 8 shows the stack 13 in the position shown in FIG. 4 with the strap end portion 42 partially wrapped around the stack as a result of its movement into the strapping position. The lower jaw 52 of the front clamp 44 is in its uppermost position and closed against the upper jaw 53 to clamp the free end 43 of the strap end portion 42 therebetween. The upper jaw 53 of the front clamp 44 comprises a portion of an anvil 54 which operates with the heat sealing element and other heat seal clamping apparatus, as will be described hereinafter. However, those heat sealing components, as well as the loading clamp 48, are shown in dashed lines in FIG. 8 in a position in which they are withdrawn laterally from the strap plane. Likewise, in FIGS. 9–15, the components of the heat sealing assembly shown in solid lines represent those disposed in the strap plane at the time of the step or steps shown and described, whereas, the components shown in phantom (dashed lines) are at that time withdrawn from the strap plane. Thus, in the FIG. 8 position, only the lower jaw 52 of the front clamp 44 and the entire anvil 54 including upper front jaw 53, are in the strap plane. The partially strapped stack 13 is supported between the upper and lower compression belts 30 and 31 (only the lower being shown in FIG. 8) with the underside of its unsupported end suspended over the anvil 54, as shown.

Figure 9:
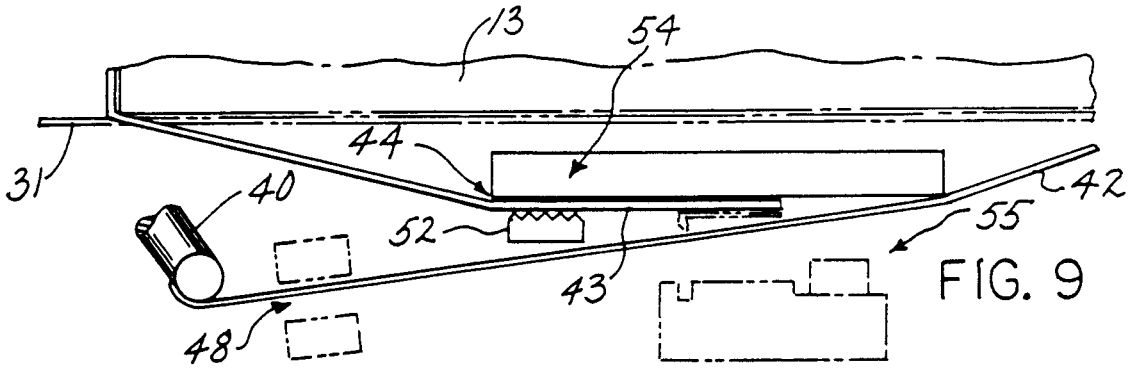
Figure 10:
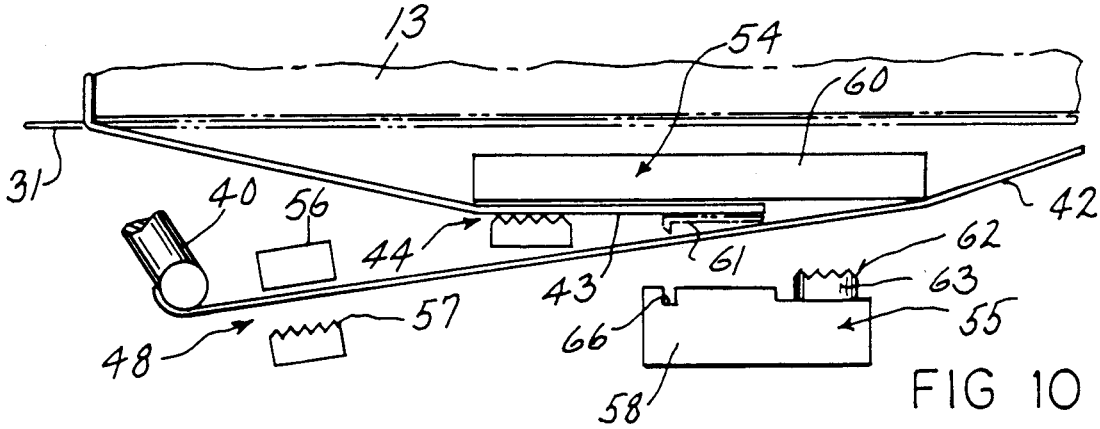

As previously indicated, as the rear end face 23 passes the second photo detector 35, movement of the stack is halted and the strap arm 40 is caused to rotate downwardly around the rear face of the stack to the sealing position shown in FIG. 9 and corresponding to the schematic position of FIG. 5. The strap end portion 42 may be caused to lengthen, as necessary, by withdrawing additional length of strap through the hollow end of the strap arm, as provided by the take-up system 41. As shown, the strap end portion 42 passes under the anvil 54 and the underside of the lower jaw 52 of the front clamp 44, and forwardly past the loading clamp 48 (which at this point remains withdrawn from the strap plane). With the free end 43 of the strap still clamped and held by the front clamp 44, the loading clamp 48 and a heat seal clamp 55 are caused to move into the strap plane, as shown in FIG. 10. The strap end portion 42 supported by the end of the strap arm 40 thus passes between the upper and lower jaws 56 and 57, respectively, of the loading clamp and the lower jaw 58 and upper jaw 60 of the heat seal clamp 55, the upper jaw 60 of which is an integral part of the anvil 54.

Figure 11:
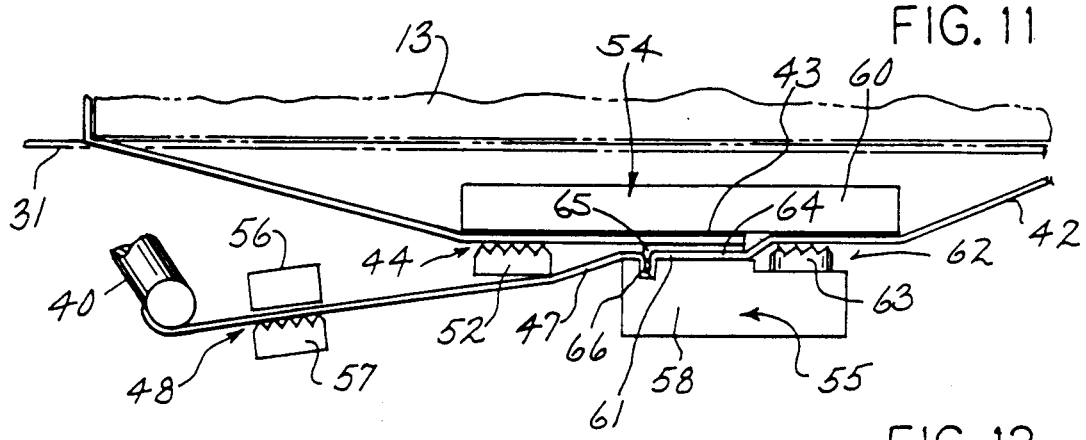

Referring next to FIG. 11, in sequence, the loading clamp 48 closes on the strap, a heating element 61 (which had previously been withdrawn from the strap plane) moves into the strap plane under the anvil and the free end 43 of the strap in the heat sealing area, and the lower jaw 58 of the heat seal clamp 55 moves upwardly to clamp the overlapping strap portion with the heating element 61 disposed against the underside of the free end of the strap. The heat seal clamp 55 includes a rear heat seal clamp 62 comprising a lower jaw 63 adapted to engage the anvil 54 when the heat seal clamp 55 closes. However, the lower jaw 63 of the rear heat seal clamp 62 extends above the heat seal clamp 55 in the open position (FIG. 10) and is spring biased for independent vertical movement with respect thereto. As the heat seal clamp moves vertically toward the anvil 54, the lower jaw 63 of the rear clamp 62 will initially engage the portion of the strap end portion 42 between it and the anvil and push it into clamping engagement therewith. As may be seen in FIG. 11, at this point the free end 43 of the strap is held by the front clamp 44, and the strap end portion 42 extending from the strap arm 40 is clamped by the loading clamp 48 forwardly of the front clamp and the rear clamp 62 rearwardly of the front clamp. Continued upward movement of the heat seal clamp 55 presses the overlapping faces of the strap against the heating element 61 to melt portions thereof for heat sealing.

The heating element 61 includes a flat horizontal platen 64 and an integral knife edge portion 65 extending integrally downward from one edge. The knife edge portion 65 is adapted to be received in a notch 66 in the clamping face of the lower jaw 58 of the heat seal clamp and, because the lower layer of the overlapping strap portion is disposed between the heating element and the lower jaw of the heat seal clamp, the strap layer will be pressed into the notch 66 and severed by a combination of melting and mechanical cutting. Movement of the components of the heat sealing assembly 45 is coordinated such that just prior to the point of maximum closure of the heat seal clamp 55 on the overlapping strap parts 42 and 43 with the heating element 61 disposed therebetween, the strap is severed and the heating element immediately retracts. The metallic heat conducting surface of the heating element may be coated with a non-stick surface, such as Teflon, to facilitate withdrawal and to minimize the sticking of melted strap material to it. The heat seal clamp 55 is held closed for a short dwell period to allow the overlapping fused strap surfaces to cool somewhat and then the heat seal clamp 55, including the rear clamp 62, and the front clamp 44 open. The remaining portion of the strap severed by the knife edge 65 provides the new free end 47 which remains securely clamped in the closed loading clamp 48.

Figure 12:
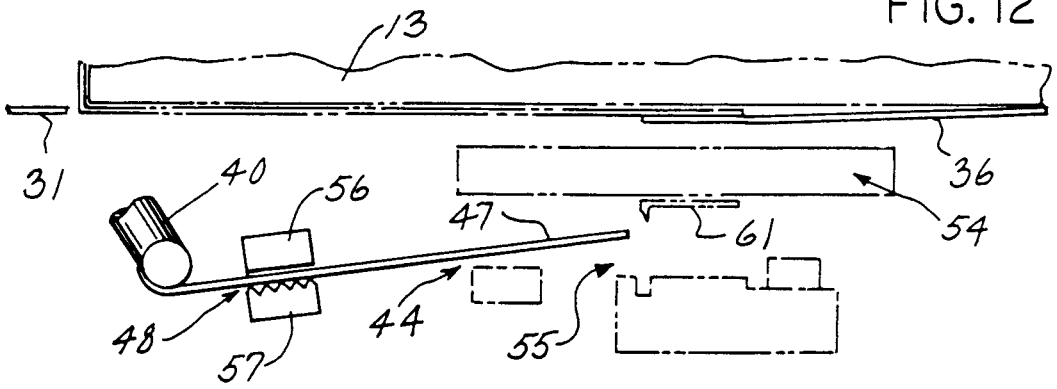
Figure 13:
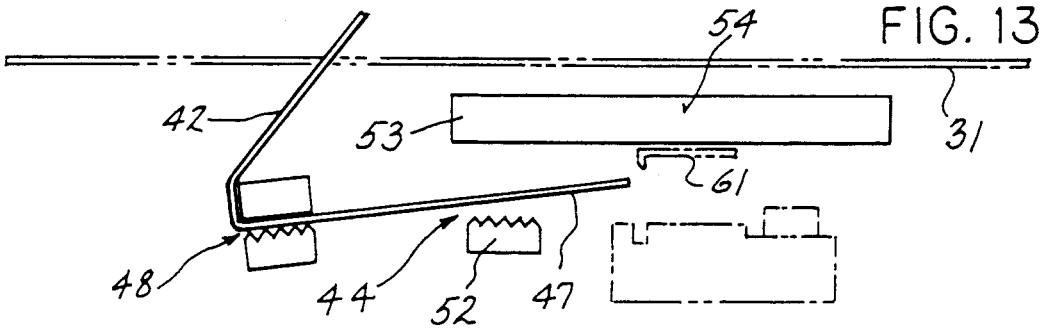
Figure 14:
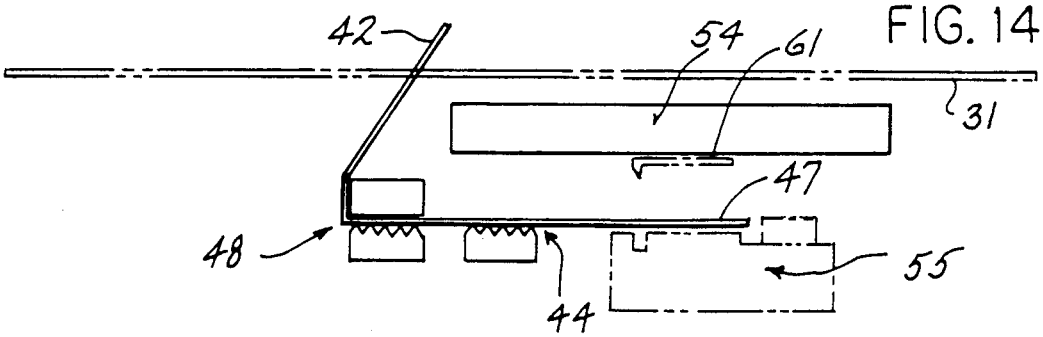
Figure 17:
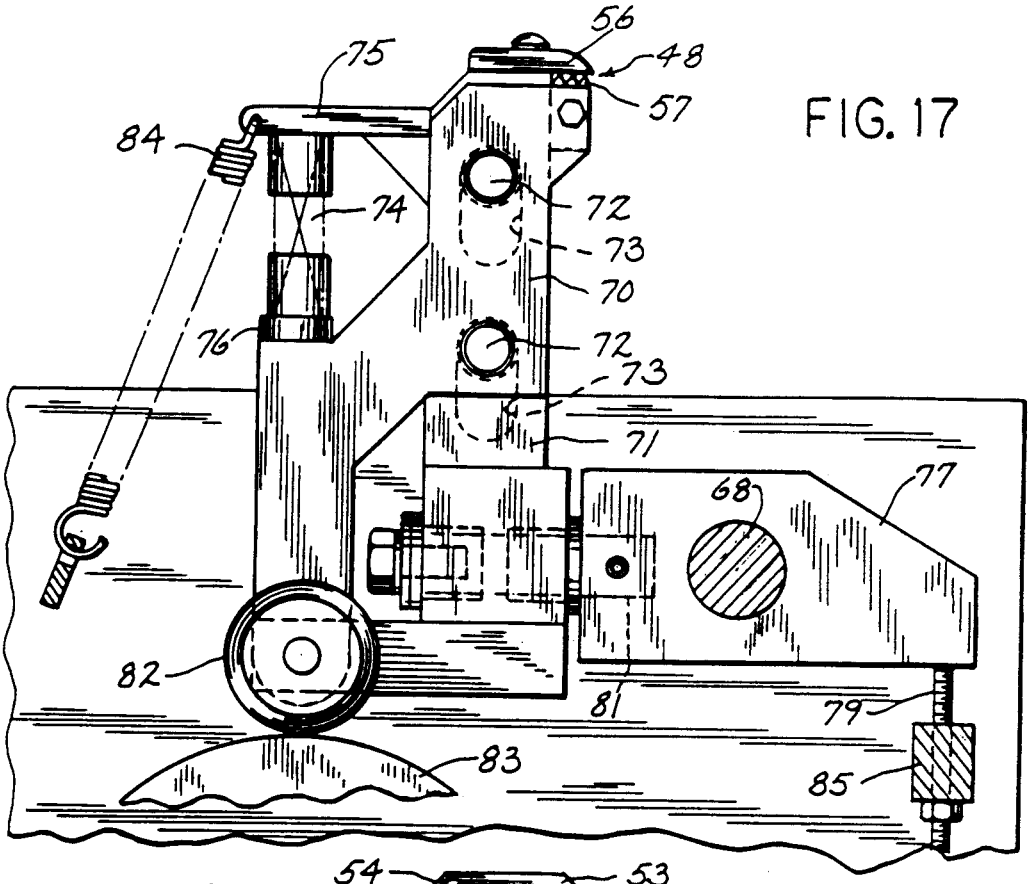
FIG. 17 is a vertical section taken on line 17—17 of FIG. 16.

Referring next to FIG. 12, as soon as the heat seal clamp 55 and front clamp 44 have opened, the entire sub-assembly, including the anvil 54, retracts and moves out of the strap plane (as shown by the dashed line representation). Withdrawal of the anvil allows the encircling strap to move up against the underside of the stack 13. With the new free end 47 of the strap end portion held in the loading clamp 48, the anvil 54 and the lower jaw 52 of the front clamp 44 move back into the strap plane with the new free end 47 disposed therebetween. As shown in FIG. 14, the loading clamp 48 then moves rearwardly in the strap plane toward the front clamp 44 and the anvil the distance sufficient to position the new free end 47 in the heat sealing region near the heating element 61 (now retracted from the strap plane). The front clamp 44 is then caused to close, as shown in FIG. 15, to clamp the new free end 47 against the anvil 54. The loading clamp 48 then opens, moves out of the strap plane, and translates back to its forward position as shown in FIG. 8, to complete the strapping cycle. At that time, the belt conveyors 30 and 31 are activated to move the stack out of the strapping station 11 to exit the system. As the rear end face 23 of the stack clear the third photo detector 50, the signal is utilized to cause the strap arm 40 to rotate upwardly through the open area 33 to its upper pre-wrapping position, as shown in FIG. 13. Again, because the new free end 47 of the strap is held by the loading clamp 48, a new strap end portion 42 will be played out by the strap arm from the supply roll 37 and intermediate take-up system 41.

Referring to FIGS. 16–19, the heat sealing assembly 45 is operated by a camshaft 67 disposed below the heat sealing assembly with its axis parallel to the direction of movement through the system. The large and relatively slow moving cams on the camshaft 67 are designed to provide one complete operating cycle of the heat sealing assembly per revolution of the camshaft. The various clamps 44, 48 and 55 and the anvil 54 are all mounted for rotation into and out of the strap plane (under the control of cam shaft 67) about a control shaft 68. The loading clamp 48, front clamp 44 and heat seal clamp 55 are all constructed such that they are spring biased to an open unclamped position and are closed against the bias of their respective bias springs by the action of the cams on the cam shaft.

The loading clamp 48 includes a pair of side plates 70, the upper ends of which are attached to a support block 49 for the lower jaw 57 and the lower ends to a similar support block (not shown). An intermediate clamp body 71 is slidably disposed between the side plates 70. A pair of horizontally disposed and vertically spaced bearing pins 72 extend between the side plates 70 through vertical slots 73 in the clamp body 71 such that the assembly of the side plates, lower jaw and bearing pins are movable vertically with respect to the clamp body 71. The bearing pins may each include a suitable needle bearing assembly to facilitate movement in the slots 73. A compression spring 74 is mounted in a compressed state between upper and lower spring mounts 75 and 76, respectively, which in turn are attached to the clamp body 71 and the side plates 70, respectively. Thus, the compressive force of the spring 74 tends to move the side plates 70 and attached lower jaw 57 downwardly with respect to the clamp body 71 to the upper end of which is attached the upper jaw 56 of the loading clamp 48. The loading clamp includes a forwardly extending connecting leg 77 which is pivotally attached to the control shaft 68 so that the loading clamp may rotate on the control shaft in either direction through a limited arc. A first cam follower 78 is attached to the lower end of the side plates 70 to engage a first cam 80 on the cam shaft 67. Movement of the first cam 80 from its low point through its intermediate point will cause rotation of the clamp assembly on the control shaft 68 and movement of loading clamp jaws 56 and 57 into the strap plane. The high point on the first cam 80 is positioned to raise the cam follower and attached side plates 70 against the bias of the compression spring 74 to cause the lower jaw 57 to engage the upper jaw 56. The cam provides sufficient dwell to hold the jaws closed for the required portion of the cycle as shown, for example, in FIGS. 11–14. As the first cam rotates beyond its high point, the bias spring 74 will cause the side plates 70 and attached lower jaw 57 to move downwardly with respect to the clamp body 71 and attached upper jaw 56, allowing the clamp to begin to open. The jaws of the loading clamp 48 will continue to open until the bearing pins 72 bottom in the vertical slots 73 and, thereafter, the entire loading clamp assembly will begin to rotate downwardly around the control shaft 68. This downward rotational movement will result in movement of the loading clamp 48 out of the strap plane.

As described generally above, the loading clamp is also subject to movement in the strap plane from a forward position (FIG. 13) to a rearward position (FIG. 14) to move the new free end 47 of the strap into the heat sealing area for clamping by the front clamp 44. To provide such movement in the strap plane, the loading clamp body 71 is pivotally attached to the connecting leg 77 by a pivot pin 81 which is disposed horizontally and normal to the axis of the control shaft 68. A second cam follower 82 is mounted laterally with respect to the first cam follower 78 and to one side of the side plates 70. The second cam follower 82 is adapted to be engaged by a second cam 83 on the cam shaft 67 adjacent the first cam 80. The second cam 83 is shaped to allow the main body of the loading clamp to rock back and forth with respect to the connecting leg 77 to provide the rearward movement in the strap plane just described and the return movement after the clamp jaws have moved out of the strap plane, to the forward position (FIGS. 8 and 9). A tension spring 84 extending downwardly from the upper rear portion of the upper spring mount 75 holds the first and second cam followers 78 and 82 in engagement with their respective cams 80 and 83 and provides a bias force against which the second cam operates to rock the loading clamp in the strap plane. A stop bar 85 is attached to the supporting structure for the heat sealing assembly and is mounted to extend under the forward end of the connecting leg 77 to provide a stop in the forward rotational direction to prevent overrotation beyond the strap plane. An adjustment screw 79 may be used to adjust and precisely set the forward rotational position. Suitable shims could alternately be used.

Figure 18:
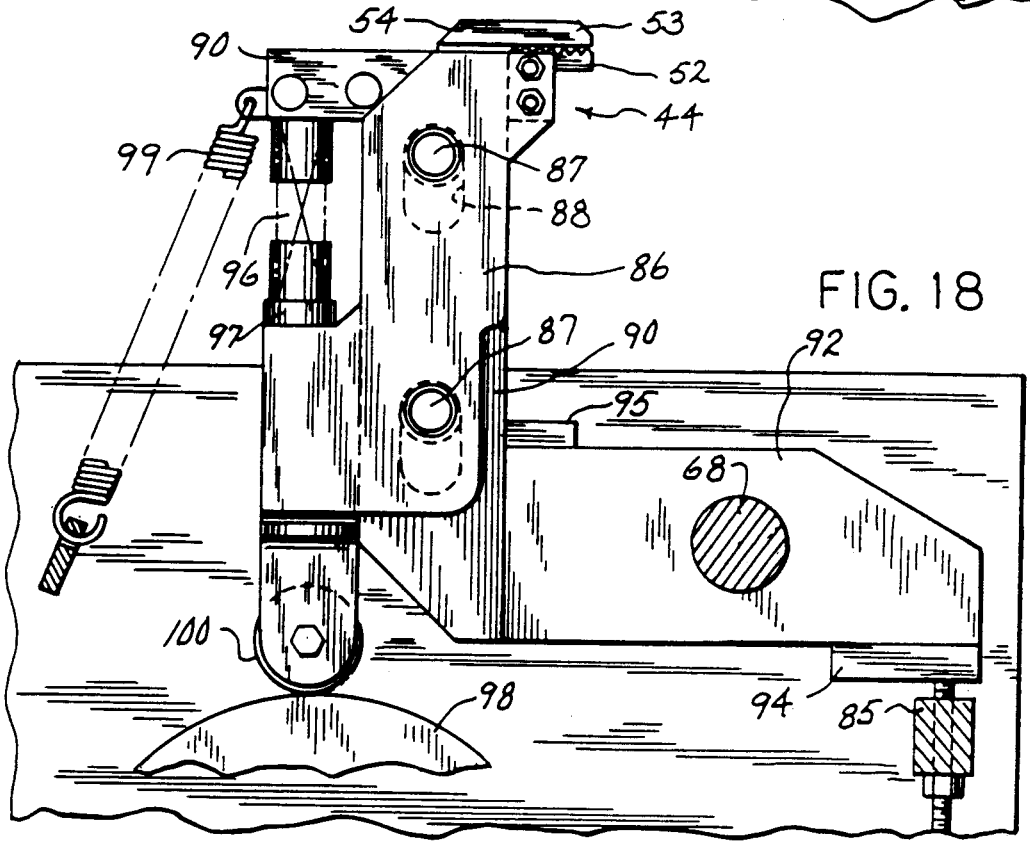
FIG. 18 is a vertical section taken on line 18—18 of FIG. 16.

FIG. 18 shows a side view of the front clamp 44 including the anvil 54 which forms its upper jaw 53. The construction and operation of the front clamp is similar to that of the loading clamp 48, described above. Thus, the front clamp 44 includes a pair of side plates 86 the upper ends of which are attached to a support block 59 for the lower jaw 52. A similar lower support block (not shown) interconnected the lower ends of the side plate 86. A pair of bearing pins 87 extend through vertical slots 88 in a clamp body 90 disposed between the side plates. The upper jaw 53, comprising the end portion of the anvil 54, is attached to the upper end of the clamp body 90. The anvil 54 extends over the heat sealing area and is attached at its opposite rearward end to the upper end of a support body 91. A connecting leg 92 is rigidly attached to the lower end of the front clamp body 90 for pivotal attachment to the control shaft 68. Similarly, a support leg 93 is rigidly attached to and extends outwardly from the lower end of the support body 91 for pivotal attachment to the control shaft 68. A support bar 94 interconnects the undersides of the outer ends of the connecting leg 92 and support leg 93. A cross brace 95 also interconnects the upper surfaces of the connecting leg and support leg to provide additional rigidity to the structure. A compression spring 96 is attached in a compressed state between the upper end of the clamp body 90 and an intermediate support plate 97 interconnecting the side plates 86 to provide a bias tending to cause the side plates and bearing pins 87 to move downwardly in the vertical slots 88 and thereby move the lower jaw 52 downwardly with respect to the anvil 54. Opening and closing movement of the jaws of the front clamp 44 and their movement into and out of the strap plane is controlled by a third cam 98 engaging a third cam follower 100 attached to the lower end of the side plates 86. In the same manner as described with respect to the loading clamp, the intermediate position of the cam 98 moves the anvil 54 and the front clamp 44 into the strap plane. The high point on the third cam 98 establishes the closed clamping position of the front clamp 44. As the diameter of the cam surface of the third cam recedes, the side plates and attached lower jaw 52 will move downwardly with respect to the clamp body 90 and attached anvil 54 causing the jaws to open. When the bearing pins 87 bottom in the vertical slots 88, the entire front clamp structure will rotate downwardly about the control shaft 68 causing the front clamp jaws to withdraw from the strap plane. Overrotation in the forward direction is prevented by engagement of the support bar 94 and the stop bar 85. The front clamp assembly is also biased by the force of a tension spring 99 to maintain the third cam follower 100 in engagement with the third cam 98, in a manner similar to the loading clamp.

Figure 19:
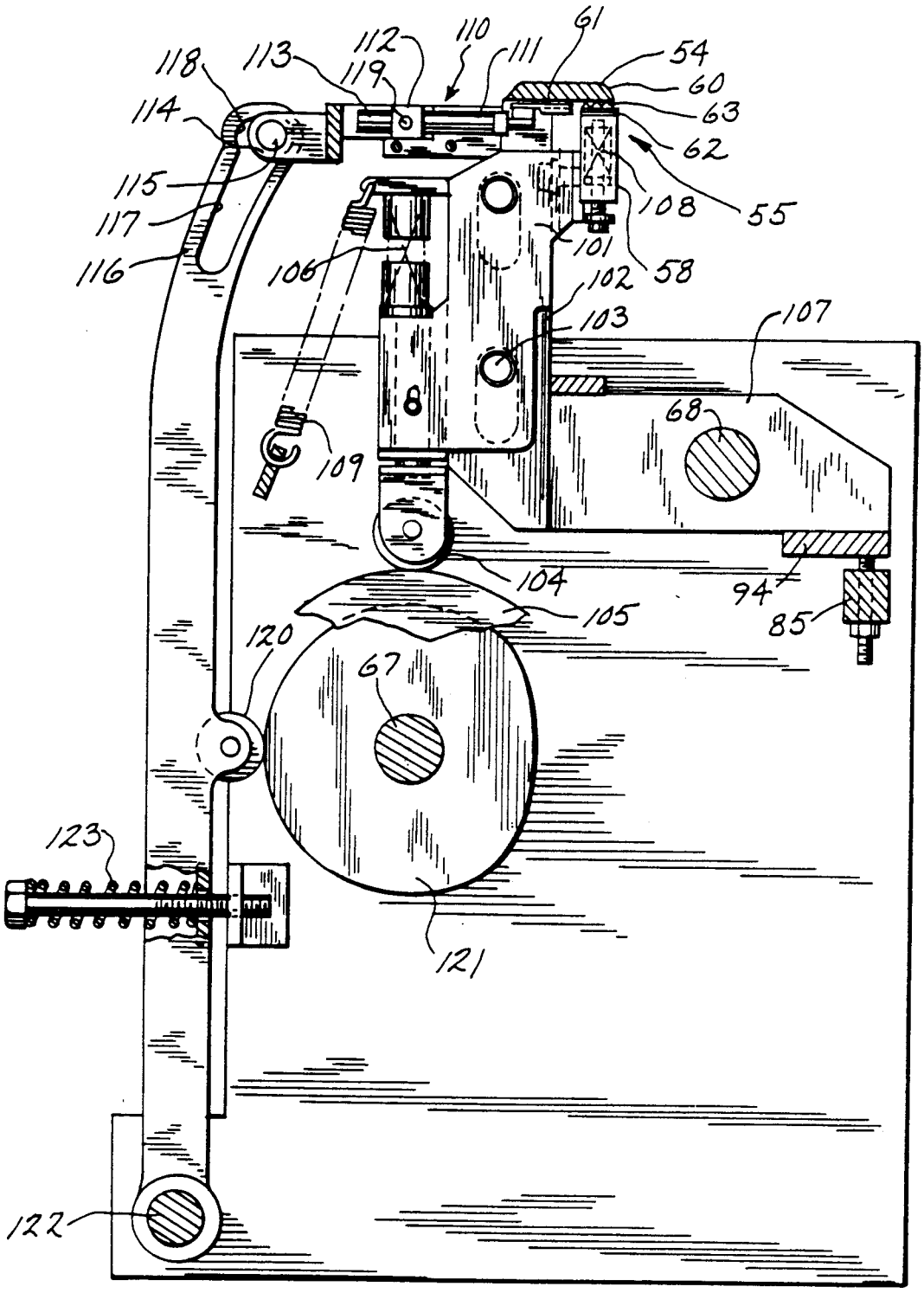
FIG. 19 is a vertical section taken on line 19—19 of FIG. 16.

The heat seal clamp 55, as shown in FIG. 19, is mounted in the open space in the front clamp structure under the anvil 54 and between the front clamp 44 and the support body 91. The heat seal clamp 55 is constructed similarly to the front clamp and loading clamp, previously described. It includes a lower jaw 58 attached to the upper ends of a pair of side plates 101 which are adapted to move vertically with respect to a clamp body 102, guided by a pair of bearing pins 103 extending between the side plates through vertical slots in the clamp body 102. The heat seal clamp is mounted for limited rotational movement via pivotal attachment of a connecting leg 107 to the control shaft 68. A fourth cam follower 104 attached to the lower ends of the side plates 101 is engaged by a fourth cam 105 to provide vertical open and closing movement of the lower jaw 58 and movement of the lower jaw into and out of the strap plane in opposition to the force of a compression spring 106. Unlike the front clamp 44 and loading clamp 48, however, the upper jaw 60 of the heat seal clamp is not attached to the clamp body 102, but instead forms an integral part of the anvil 54 which, as previously described, is rigidly attached to the front clamp body 90 for movement with the front clamp assembly. Thus, the heat seal clamp lower jaw 58 is capable of movement into and out of the strap plane independently of its upper jaw 60 and the anvil 54. This separation of functions is also clear from the preceding description of the overall operation of the heat sealing assembly where the anvil 54 remains in the strap plane for a substantially longer portion of the strapping and heat sealing cycle than the heat seal clamp. The heat seal clamp lower jaw 58 also includes the rear clamp 62 which comprises a moveable lower jaw 63 and a portion of the anvil 54 as its upper jaw. As indicated previously, as the heat seal clamp closes against the overlapping strap portion and heating element disposed therebetween, the lower jaw 63 of the rear clamp is disposed slightly above the surface of the heat seal clamp lower jaw 58 such that lower jaw 63 engages a single layer of the strap end portion 42 immediately adjacent the overlapping strap portion in the heat sealing area. The lower jaw 63 is slidably mounted in a vertical bore in the heat seal clamp and moves downwardly against the bias of a coil spring 108 as it engages the anvil 54 upon closing of the heat seal clamp, as shown in FIGS. 10 and 11. Rotation of the heat seal clamp 55 beyond the strap plane is prevented by engagement of the underside of the connecting leg 107 and the support bar 94. A tension spring 109 is attached to the upper end of the clamp body 102 and to the heat seal assembly supporting structure to bias the fourth cam follower 104 into engagement with the fourth cam 105.

As also shown in FIG. 19, the heating element 61 is mounted to the front clamp structure by a heating element slide assembly 110 attached to the upper inside faces of the clamp body 90 and support body 91. The heating element platen 64 is attached to a heater body 111 which includes a heating element yoke 112 having a pair of pivots 119 mounted for minimal pivotal movement in a pair of brass slider blocks 113. The slider blocks are in turn mounted to slide horizontally in the slide assembly 110 to carry the heating element platen into and out of the strap plane just beneath the anvil 54. A heating element driver 114 is attached to the rear end of the slider blocks 113 and includes a drive bearing and pin 115 which is received in an arcuate slot 117 in a generally vertically disposed control arm 116. The upper end of the slot 117 includes a driver notch 118 adapted to engage the bearing and pin 115 and hold it for forward movement with the driver and attached slider blocks 113. The control arm 116 extends downwardly behind the heat sealing assembly and includes a fifth cam follower 120 attached to an intermediate portion thereof and engageable by a fifth cam 121 attached to the cam shaft 67. The lower end of the control arm 116 is pivotally mounted on a pivot bar 122 and the control arm is biased in a forward direction by a bias spring 123. Thus, the heating element is normally biased to move into the strap plane, but is allowed to so move into the strap plane and is moved out of the strap plane against the bias of the spring 123 by the fifth cam 121. As described previously, the heating element moves into and out of the strap plane independently of the movement of the front clamp and anvil assembly to which it is attached. Therefore, the arcuate slot 117 in the control arm 116 provides clearance for rotary movement of the driver pin 115 as it rotates out of the strap plane independently of the front clamp and anvil assembly.

As shown in FIGS. 20 and 21, the strap supply roll 37 is rotatably attached to the end of a driven shaft 124 for carrying the strap arm 40. However, the supply roll is mounted to rotate freely and independently of rotation of the driven shaft and strap arm. Also attached to the shaft 124 is a strap arm and take-up mounting assembly 125 adapted to rotate with the strap arm independently of the strap supply roll 37. The mounting assembly 12 provides for attachment of a strap arm fixed end section 126 for the strap arm 40 and a support leg 127 for the take-up 41. The mounting assembly 125 also includes an integral rotatable hub 128 secured to the driven shaft and adapted to carry the strap arm 40 and take-up 41 through controlled 180° arcs of rotation. The driven shaft 124 is mounted to rotate in a bearing 129 on the upper end of a support arm 130. The driven shaft has a driven sprocket 145 mounted on its outer end adapted to be driven by a motor 139 via a drive belt and sprocket 140 and 141, respectively. Operation of the motor to rotate the strap arm may be controlled by the rear face 23 of the stack clearing photodetectors 35 and 50. The take-up system 41 includes a series of first take-up idler rollers 131 rotatably attached to a roller shaft 133 extending horizontally from the upper end of the support leg 127, and a series of second take-up rollers 132 rotatably attached to another roller shaft 134 horizontally attached to the end of the fixed strap arm section 126. The radially inner end of the support leg 127 carrying the first take-up rollers 131 is pivotally attached to the hub 128 to move toward and away from the second take-up rollers 132 under the control of a spring operated extensible cylinder 135. The strap 36 from the supply roll 37 (which strap may conveniently be made of polypropylene material) is threaded back and forth between opposite pairs of first and second take-up rollers and then into a generally horizontally disposed end section 136 of the strap arm 40. The strap extends through the hollow horizontal strap arm section 136 and out of the free inner end thereof which is disposed approximately on the centerline 15 of the system. In its threaded attachment to the horizontal strap arm section 136, the strap material is subjected to two 90° turns each of which is accommodated by disposing a short cylindrical length of bar stock 137 and 138 on a skewed 45° angle in the path of travel of the strap which, when wrapped partially therearound, reorients the strap to exit in a direction approximately 90° from the incoming direction. An important feature of mounting the strap supply roll 37 coaxially with the strap arm 40 on the driven shaft 124 is that the strap may be fed continuously without twisting as the arm rotates around the roll.

Figure 22:
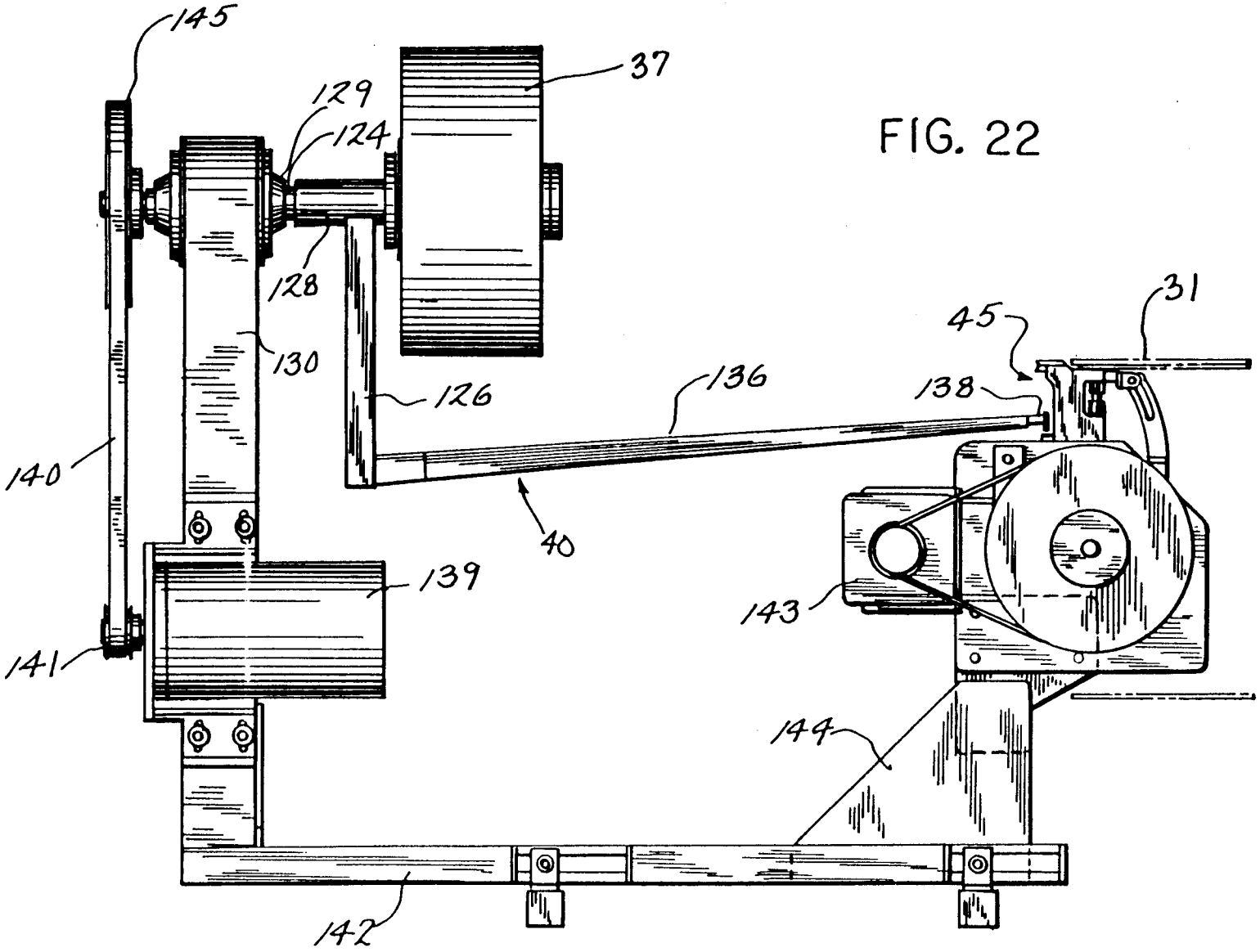
FIG. 22 is an end view, looking upstream, of the carriage for the strap arm and heat sealing assembly.

Referring to FIGS. 2 and 22, the strap supply roll 37, strap arm 40 and take-up system 41 subassembly and the entire heat sealing assembly 45 may be mounted on a movable platform 142 which can be moved laterally within the open area 33 in the strapping station to position the end of the strap arm 40 offset somewhat from the centerline of the system. In this manner, stacks of corrugated sheets which, for example, may have notches or grooves disposed on the centerline of the system, may be wrapped with a slightly offset strap while still maintaining the stack in its preferred orientation centered on the system centerline. The strapping suport arm 130 is attached to the lateral outer end of the platform 142 and the heat sealing assembly 45, including its drive motor 143, is mounted on a support bracket 144 on the lateral inner end of the platform.

Overall cycle time and strapping efficiency of the system may be improved by utilizing a programmable controller to limit the total extent of reciprocal movement of the side tamps 16 and the upper belt conveyor 30 for a particular size stack being strapped. For example, for a narrower and/or lower stack profile, a system controller may be programmed to locate the side tamps closely spaced from the sides of the stacks in their initial position and the upper belt conveyor 30 positioned closely spaced from the top of the uncompressed stack.

Thus, the total movement of either the side tamps or belt conveyor in both directions may be limited and the time required for their respective operation thereby reduced.

Whether the stacks 13 are processed through the system of the present invention including strapping or not, accurate location of the exact center of each stack may be retained, so that the precise orientation of each stack may be picked up by automated downstream handling equipment. The stack is always maintained on the system centerline 15, as previously indicated, to establish the lateral center of the stack (or its longitudinal centerline). The longitudinal center of the stack (on its lateral centerline) may be easily established by detection of movement of one face, such as the trailing edge, past a photodetector and utilizing the known stack length stored in the system controller and the speed of the conveyor. Establishment of this stack center position, i.e. the vertical centerline, provides the basis for controlling downstream repositioning of the stack, which may include rotation, as well as translation, in a horizontal plane.

Various modes of carrying out the present invention are contemplated as being within the scope of the following claims particularly pointing out and distinctly claiming the subject matter which is regarded as the invention.

We claim:

1. A system for strapping a compressible stack of sheet material comprising:

a squaring station including first conveyor means for conveying the stack into the squaring station;

a pair of side tamps disposed over the first conveyor means on opposite sides of the stack and movable laterally to engage and square the side faces of the stack and to position the stack with respect to the system centerline;

second conveyor means attached to each of said side tamps and including vertically disposed pusher dogs adapted to engage the vertical rear edge of the stack to square the forward and rear end faces thereof and to move said stack out of the squaring station;

a strapping station including third conveyor means for receiving the squared stack from the squaring station and moving the stack into a strapping position within the strapping station;

said third conveyor means including upper and lower conveyor belts offset laterally to one side of and parallel to the centerline of the system, one of said belts being movable vertically toward the other to compress the stack therebetween as the stack is moved into the strapping position and to hold the stack by said one side such that at least a portion of the stack on the other side of the centerline is unsupported;

strapping means, including a supply of a continuous length of strap, for supporting an end portion of said strap in a pre-wrap position in a vertical plane parallel to the centerline of the stack and for wrapping said strap end portion around the forward face and portions of the upper and lower faces of the stack in response to movement of the stack into the strapping position and into engagement with said strap end portion;

said strapping means further including a rotary strap arm adapted to support said strap portion opposite its free end and to rotatably carry said strap portion in said vertical plane around the rear face of the stack to a sealing position overlapping the free end; and, means for connecting the free end and overlapping strap portion to enclose the stack.

2. The system as set forth in claim 1 wherein said strap arm is rotatable around the unsupported portion of the stack.

3. The system as set forth in claim 2 including strap cutting means operable with said connecting means for severing the strap adjacent the enclosing connection.

4. The system as set forth in claim 3 wherein the rotation of said strap arm is unidirectional.

5. The system as set forth in claim 4 wherein rotation of said strap arm between said connecting and pre-wrap positions is through an arc of approximately 180°.

6. The system as set forth in claim 4 wherein the centerline of the stack in the strapping position lies in said vertical strap plane.

7. The system as set forth in claim 4 wherein said connecting means comprises a heat sealer.

8. The system as set forth in claim 7 wherein said strap cutting means is integral with said heat sealer.

9. The system as set forth in claim 1 wherein said second conveyor means includes pivotal gate means on the downstream end of said second conveyor means disposed in the path of the stack being moved by said pusher dogs, said gate means including release means for allowing the gates to pivot out of the path of the stack after squaring.

10. The system as set forth in claim 9 wherein said gate means includes a pivotal gate for each of said side tamps.

11. The system as set forth in claim 1 wherein said strap supply comprises a roll of strap mounted on the axis of rotation of said strap arm for independent rotation with respect thereto.

12. The system as set forth in claim 11 including strap take-up means mounted for rotation with said strap arm for receiving strap from said roll and delivering said strap on demand to said strap arm in response to rotation thereof.

13. The system as set forth in claim 12 wherein said strap arm comprises a generally hollow horizontally disposed member adapted to receive the strap from said take-up means and including an open free end disposed in said vertical strap plane.

14. A system for strapping a vertically compressible stack of sheet material comprising:

a feed conveyor adapted to support the stack for movement into the system and to engage and square the vertical faces of the stack;

a pair of vertically spaced belt conveyors disposed adjacent the downstream end of the feed conveyor, the upper of said belt conveyors being movable vertically with respect to the lower belt conveyor;

said belt conveyors adapted to initially receive the downstream end of the squared stack while the upstream end is engaged by said feed conveyor and to compress and capture said squared stack therebetween;

said belt conveyors being offset laterally from the centerline of the system and operable to support and convey the compressed stack to a strapping position wherein at least a portion of the stack opposite the belt conveyors is unsupported;

means for applying an encircling strap to the compressed stack in a vertical plane parallel to the direction of movement of the stack through the system, said means including a rotary strap arm adapted to carry the strap around the unsupported portion of the stack;

sealing means for securing said encircling strap in a closed loop; and, said belt conveyors being further operative to convey the strapped stack to a fully supported downstream position at which position said upper belt conveyor is moved upwardly to release the compressed stack.

15. The system as set forth in claim 14 wherein said unsupported portion of the stack includes the upstream end thereof.

16. The system as set forth in claim 15 wherein the strap applying means includes a supply of a continuous length of strap.

17. The system as set forth in claim 16 wherein said strap applying means includes a strap clamping means positioned beneath the stack in the strapping position, said strap clamping means comprising a front clamp adapted to hold the free end of the strap and to cooperate with said strap arm to position a strap end portion in the path of movement of the stack into said strapping position, whereby the strap end portion is wrapped partially around the stack in response to said movement.

18. The system as set forth in claim 17 wherein said strap arm is adapted to carry the strap end portion from its partially wrapped position to a position overlapping the free end thereof to provide said encircling strap.

19. The system as set forth in claim 18 wherein the sealing means comprises a heat sealing apparatus including a heating element movable into the plane of said encircling strap between the free end and overlapping end portion thereof to melt opposing face portions thereof.

20. The sytem as set forth in claim 19 wherein said heat sealing apparatus includes heat seal clamping means operative in response to movement of said heating element into the strap plane for clamping said opposing face portions together, and wherein said heating element is movable out of the strap plane in advance of said clamping.

* * * * *